US007255163B2

(12) United States Patent
Rivard

(10) Patent No.: US 7,255,163 B2
(45) Date of Patent: Aug. 14, 2007

(54) CONVERTIBLE ROTARY SEAL FOR PROGRESSING CAVITY PUMP DRIVEHEAD

(76) Inventor: Raymond P. Rivard, 4510 48th Street, Beaumont, Alberta (CA) T4X 1G4

( * ) Notice: Subject to any disclaimer, the term of this patent is extended or adjusted under 35 U.S.C. 154(b) by 192 days.

(21) Appl. No.: 10/914,809

(22) Filed: Aug. 10, 2004

(65) Prior Publication Data

US 2006/0032635 A1 Feb. 16, 2006

(51) Int. Cl.
*E21B 19/00* (2006.01)
*E21B 33/02* (2006.01)

(52) U.S. Cl. ..... 166/84.1; 166/88.1; 166/76.1

(58) Field of Classification Search ..... 166/84.1, 166/84.4, 76.1, 78.1, 85.3, 85.5, 88.1, 84.5; 415/229, 230; 277/300, 320, 336, 326, 322; 175/195

See application file for complete search history.

(56) References Cited

U.S. PATENT DOCUMENTS

| | | | | |
|---|---|---|---|---|
| 4,773,834 A | | 9/1988 | Saruwatari | |
| 5,209,294 A | | 5/1993 | Weber | |
| 5,209,495 A | | 5/1993 | Palmour | |
| 5,429,188 A | * | 7/1995 | Cameron et al. | 166/78.1 |
| 5,474,432 A | | 12/1995 | Hulley et al. | |
| 5,501,580 A | | 3/1996 | Barrus et al. | |
| 5,628,516 A | * | 5/1997 | Grenke | 277/300 |
| 5,639,227 A | | 6/1997 | Mills | |
| 5,791,411 A | | 8/1998 | Ricalton et al. | |
| 5,823,541 A | | 10/1998 | Dietle et al. | |
| 6,371,487 B1 | | 4/2002 | Cimbura, Sr. | |
| 6,675,902 B2 | | 1/2004 | Rowan et al. | |
| 6,739,390 B1 | | 5/2004 | Kimberley | |
| 7,086,473 B1 | | 8/2006 | Bangash | |
| 2006/0082069 A1 | * | 4/2006 | Malavazi | 277/322 |

FOREIGN PATENT DOCUMENTS

WO WO 2004092539 A1 * 10/2004

OTHER PUBLICATIONS

Giangiacomo, Leo A., Test Project Report, "Hydro-Balanced Stuffing Box Field Test," Rocky Mountain Oilfield Testing Center (Casper, WY), (May 28, 1999) (prepared for the U.S. Department of Energy).

* cited by examiner

*Primary Examiner*—Kenneth Thompson
(74) *Attorney, Agent, or Firm*—Fellers, Snider, Blakenship, Bailey & Tippens

(57) ABSTRACT

A convertible rotary seal has a housing for receiving a polish rod. A mandrel is rotatably mounted in the seal housing and surrounds the polish rod. A wear sleeve surrounding the mandrel engages a primary seal. A secondary seal engages the mandrel and polish rod and rotates therewith but may be converted for use as a static seal if necessary. A locking mechanism selectively secures the mandrel in a stationary orientation with respect to the seal housing. Fluid that leaks past the primary seal will be detectible through an external orifice. If a leak in the primary seal is detected via the external port, then the mandrel may be secured in a stationary orientation with respect to the housing and the secondary seal may be reconfigured to operate as a stationary seal until such time as the rotary sealing unit can be overhauled.

23 Claims, 4 Drawing Sheets

*Fig. 4*
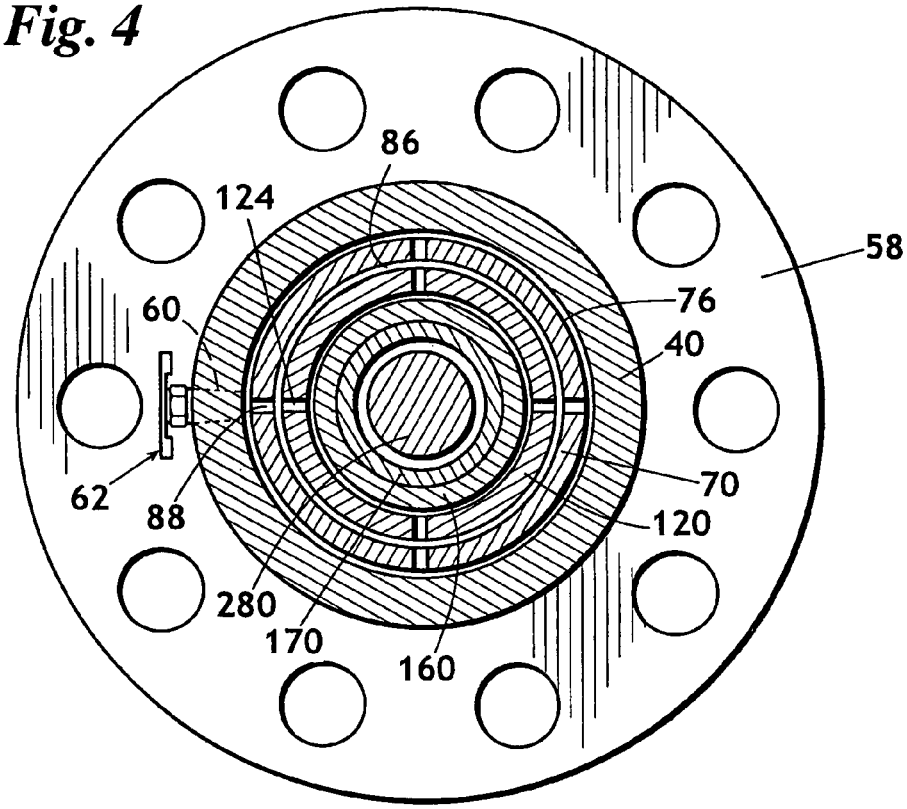
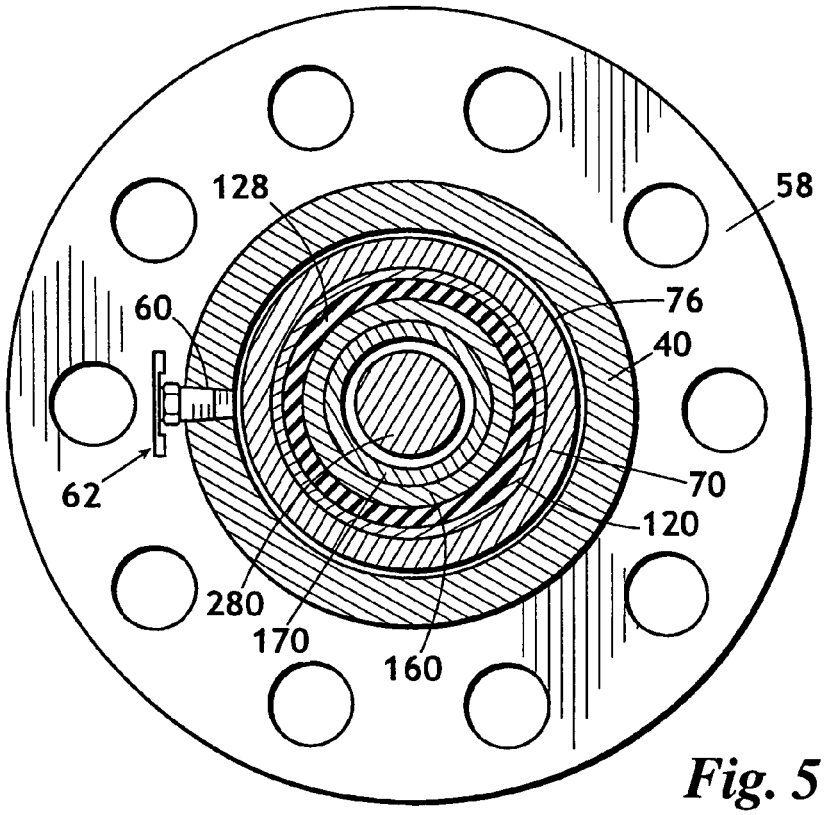
*Fig. 5*

CONVERTIBLE ROTARY SEAL FOR PROGRESSING CAVITY PUMP DRIVEHEAD

FIELD OF THE INVENTION

This invention relates generally to a wellhead stuffing box for sealing engagement with a polish rod. More particularly, the invention relates to a stuffing box having a primary and a secondary seal for use with a rotating polish rod.

BACKGROUND OF THE INVENTION

In a standard wellhead, a stuffing box is used to provide a rotary seal around the polish rod of a rod string, which is used to drive a downhole pump. A typical stuffing box is constructed of a generally tubular housing that is threaded onto an upwardly projecting portion of a wellhead. The polish rod extends through the wellhead and through the stuffing box housing. An annular space is formed between stuffing box housing and the polish rod. Typically, a stack of compressible packing rings are positioned in the annular space to form a seal around the polish rod. An internal radial shoulder in the stuffing box housing supports the packing rings at a bottom end of the stack. An annular packing gland is typically positioned at the top of the stack of packing rings. An internally threaded compression nut is threaded onto an externally threaded upper end of the stuffing box housing to force the packing gland downwardly to compress the packing rings against the radial shoulder of the stuffing box housing. When the packing rings are compressed, the packing rings experience radial expansion, so that the rings seal against the polish rod and also against the inside surface of the stuffing box housing.

Problems associated with typical stuffing boxes include leakage and packing wear. A problem with progressive cavity pumps in particular is that the rod string is oftentimes not perfectly straight. Additionally, the rod string tends to oscillate during rotation, which can exacerbate packing wear and may result in the escape of pressurized well fluid.

Therefore, it is desirable to provide a stuffing box having a primary and a secondary seal to increase reliability of the stuffing box. It is further desirable to be able to detect when the primary seal has developed a leak so that repairs can be made before well fluid can escape. Once primary seal leakage is discovered, it is desirable for the stuffing box to have features that enable the stuffing box to be adapted for continued use with the secondary seal until such time as repairs can be made in a convenient and cost effective manner. Additionally, it is desirable to provide a sleeve for shielding the polished rod from sealing elements during operation to avoid polish rod wear.

SUMMARY OF THE INVENTION

The rotary seal unit ("RSU") of the invention is characterized by seal elements, such as lip seals, that run on a rotating mandrel. By utilizing a rotating mandrel the polish rod is isolated from running elements, which eliminates wear of the polish rod. A top part of the mandrel has a chamber containing a poly seal that seals and grips the polish rod. The polish rod drives the mandrel, which is sealed by multiple lip seals. The space between the multiple lip seals communicates through various machined holes and cavities with an exterior port. An operator may open the exterior port to check for fluid. A fluid presence proximate the exterior port indicates a failure of one or more of the lower lip seals. Thus, the failure of the RSU may be detected before well fluid leakage occurs.

Replacement of a drivehead rotary seal requires removal of the drivehead, which can be a time consuming and perhaps untimely procedure. The RSU of the invention allows for the drivehead to be shut down and for the mandrel to be locked to the body of the RSU. The top seal, e.g., a poly seal, may then be replaced by a stationary seal such as Teflon and graphite packing. Once the packing is installed, the top seal becomes static. In this way the RSU of the invention may be operated as a conventional stuffing box until replacement of the RSU is convenient to field operations.

Advantages of the RSU of the invention include utilizing multiple lip seals as a primary seal and utilizing a secondary static seal that includes conventional poly-style packing. The system of the invention provides an early warning in advance of a primary seal failure. In the event of a primary seal failure, the secondary seal can be converted to avoid an unscheduled shutdown of the pumping system. The secondary sealing system operates as a conventional stuffing box using Teflon and graphite packing that can continue to be utilized until a maintenance event can be scheduled, thus avoiding a costly addition shut-down.

An added benefit of the RSU of the invention is reduced polished rod wear. The primary seals are designed so that while in operation the wear to the polished rod is reduced or eliminated.

BRIEF DESCRIPTION OF THE DRAWINGS

FIG. 4 is a cross-sectional view taken along line 4-4 of FIG. 2.

FIG. 5 is a cross-sectional view taken along line 5-5 of FIG. 2.

DETAILED DESCRIPTION OF THE PREFERRED EMBODIMENT

Figure 1:
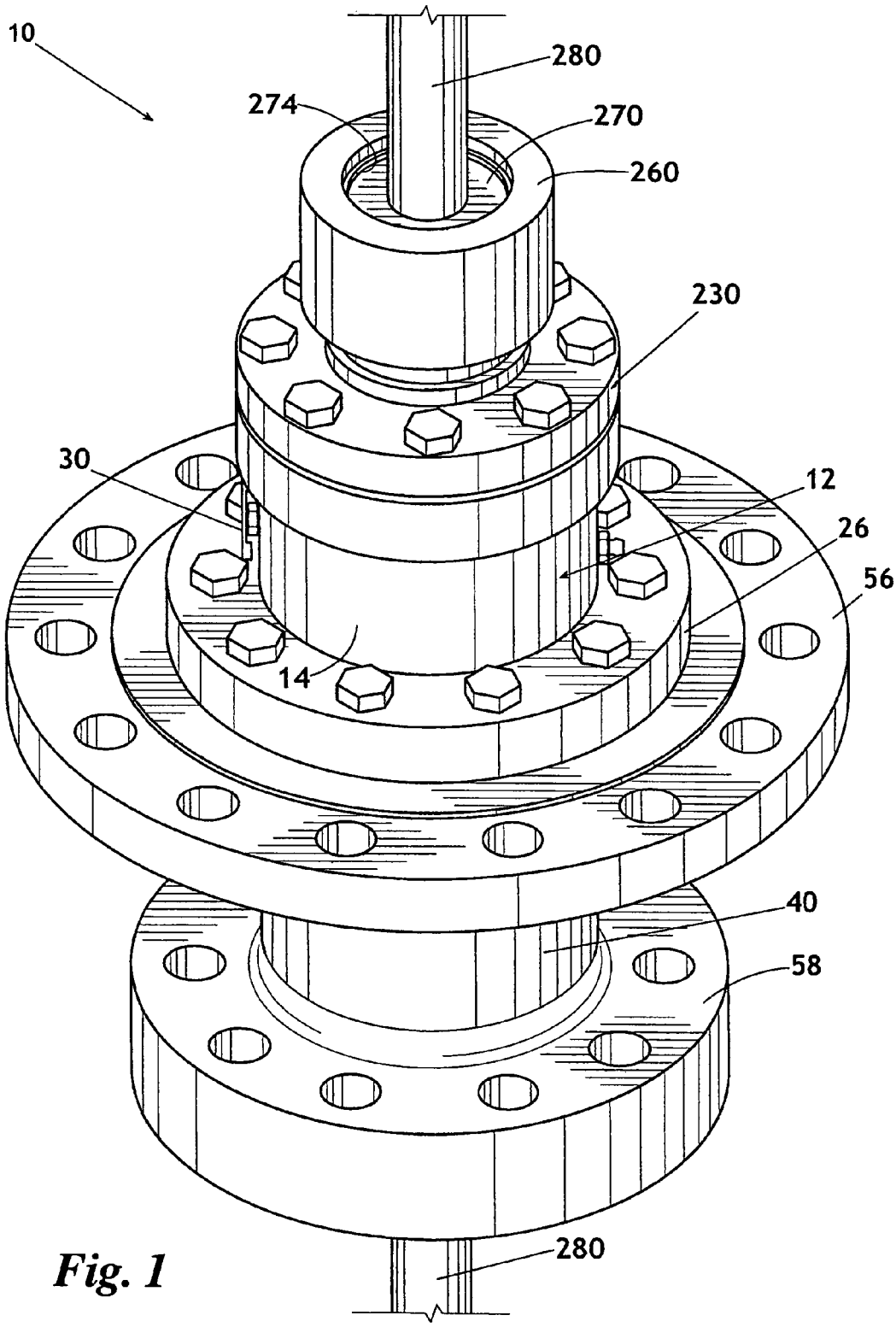
FIG. 1 is a perspective view of the convertible rotary seal of the invention.
Figure 2:
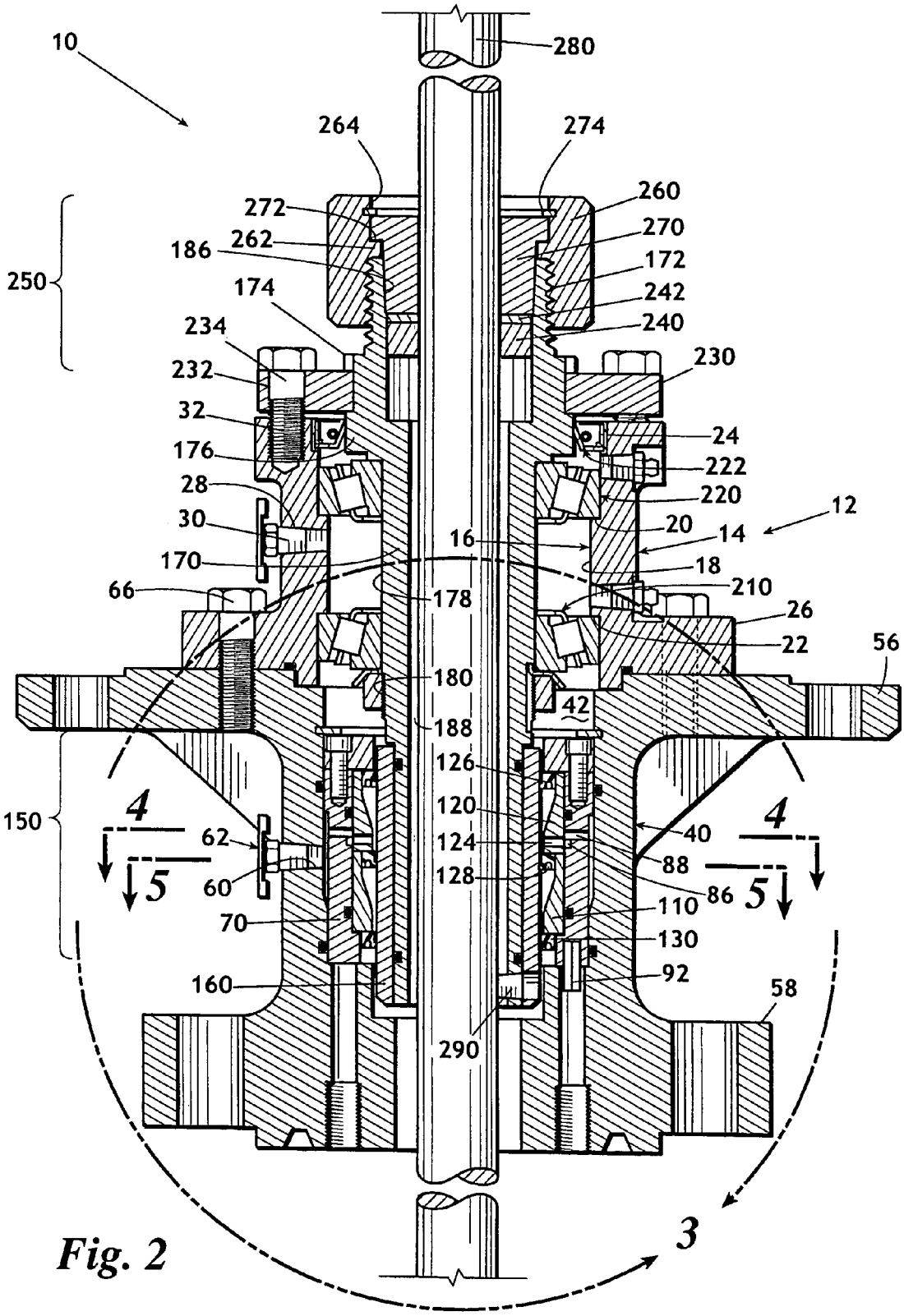
FIG. 2 is a cross sectional view of the convertible rotary seal of FIG. 1.

Referring now to FIGS. 1-5, rotary seal 10 for a progressive cavity pump drivehead is shown. Rotary seal 10 includes a housing 12. Housing 12 is preferably made up of a bearing housing 14 (FIGS. 1 and 2) and a seal housing 40. Bearing housing 14 defines an inside surface 16 having an interior ring 18 (FIG. 2). Interior ring 18 defines an upper shoulder 20 and a lower shoulder 22. Bearing housing 14 defines an upper diameter 24 and a lower flange 26. Bearing housing 14 additionally defines an orifice 28 that receives an upper breather petcock 30 (FIGS. 1 and 2). Bearing housing 14 further defines a plurality of bolt receiving holes 32 and an upper surface of the bearing housing 14.

Figure 3:
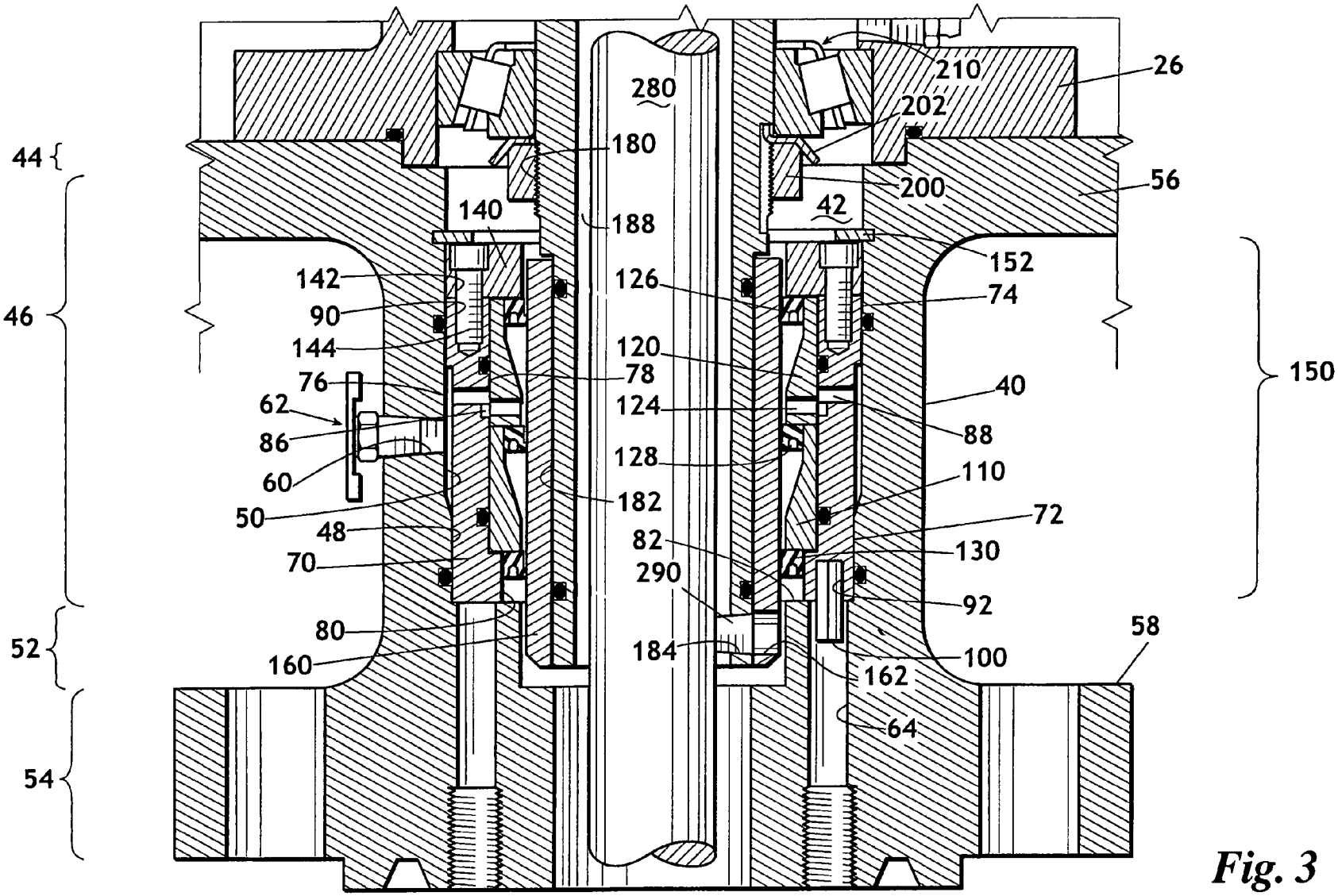
FIG. 3 is an enlarged view of lower seal assembly of the cross sectional view of the convertible rotary seal shown in FIG. 2.

As can best be seen in FIG. 3, housing 12 additionally is made up of seal housing 40 (FIGS. 1-5). Seal housing 40 defines an interior cavity 42 (FIGS. 2 and 3) having a first or mating section 44 of a first diameter, a second or seal section 46 having a lower diameter 48 and a larger upper diameter 50. Interior cavity 42 of seal housing 40 additionally includes a third or sleeve section 52 having a diameter and a fourth or lower section 54 having a diameter. Seal housing 40 further defines a booth flange or upper flange 56 and a lower flange 58. Seal housing 40 defines an orifice 60 for receiving a lower breather or leak detection petcock 62 (FIGS. 2-5) at second or seal section 52. Orifice 60 communicates interior cavity 42 of seal housing 40 with an exterior of seal housing 40. Seal housing 40 further defines at least one roll pin orifice 64 in the lower surface thereof. Cap screws 66 pass through lower flange 26 of bearing housing 14 and upper flange 56 of seal housing 40 for securing bearing housing 14 to seal housing 40.

Still referring primarily to FIG. 3, a stationary cartridge 70 (FIGS. 2-5) is located in the second or seal section 46 of seal housing 40. Stationary cartridge 70 has an outside surface that has a first outside diameter 72 in mating contact with the lower diameter 48 of second or seal section 46 of seal housing 40. Stationary cartridge 70 additionally has a second larger outside diameter 74 that communicates with the larger upper diameter 50 of the second section 46 of seal housing 40. The outside surface of stationary cartridge 70 and the inside surface of interior cavity 42 of seal housing 40 define annular space 76 (FIGS. 3-5) therebetween. Annular space 76 is in communication with orifice 60 of seal housing 40.

Still referring to FIG. 3, stationary cartridge 70 has an inside surface that defines an upper inside diameter 78 and a lower inside diameter 80 wherein lower inside diameter 80 defines an annular plane 82 and a lower lip seal receiving area. Stationary cartridge 70 defines an interior annular groove 86 on upper inside diameter 78. Stationary cartridge 70 further defines an orifice 88 in communication with interior annular groove 86 on upper inside diameter 78 of stationary cartridge 70 for communicating with annular space 76. Stationary cartridge 70 defines a plurality of bolt receiving orifices 90 on an upper surface thereof. Stationary cartridge 70 further defines at least one roll pin orifice 92 on a lower surface thereof.

Roll pin 100 is preferably located in roll pin orifice 64 of seal housing 40 is preferably partially inserted within roll pin orifice 92 of stationary cartridge 70 for preventing rotation of stationary cartridge 70 with respect to seal housing 40. A first O-ring is located between the second or seal mating section 46 of seal housing 40 and the upper inside diameter 78 of stationary cartridge 70. A second O-ring is also located between the second or seal section 46 of seal housing 40 and the lower inside diameter 80 of stationary cartridge 70.

A lower lip seal spacer 110 is received within the upper inside diameter 78 of stationary cartridge 70. An O-ring seal is preferably provided between stationary cartridge 70 and lower lip seal spacer 110 for forming a seal therebetween. Lower lip seal spacer 110 communicates with annular plane 82 of stationary cartridge 70. Lower lip seal spacer 110 defines a tapered inside surface defining a middle lip seal receiving area.

Upper lip seal spacer 120 is received within upper inside diameter 78 of stationary cartridge 70. Upper lip seal spacer 120 communicates with an upper surface of lower lip seal surface 110. Upper lip seal spacer 120 defines a tapered inside surface defining an upper lip seal receiving area. Upper lip seal spacer 120 additionally defines a spacer orifice 124 that is in communication with interior annular groove 86 of stationary cartridge 70.

Upper lip seal 126 is located adjacent to the upper lip seal receiving area of upper lip spacer 120. Middle lip seal 128 is located adjacent the middle lip seal receiving area of lower lip seal spacer 110. Additionally, lower lip seal 130 is located adjacent the lower lip seal receiving area of stationary cartridge 70. An O-ring is provided between the inside surface of stationary cartridge 70 and outside surface of upper lip seal spacer 120 for forming a seal therebetween. The O-ring is located above spacer orifice 124 of upper lip seal spacer 120 and also above interior annular groove 86 and orifice 88 of stationary cartridge 70.

Cartridge lid 140 is located within second section 46 of seal housing 40. Cartridge lid 140 communicates with an upper surface of stationary cartridge 70. Cartridge lid 140 defines a plurality of bolt receiving orifices 142. A plurality of bolts 144 are received in bolt receiving orifices 142 of cartridge lid 140 and in bolt receiving orifices 90 of stationary cartridge 70 for securing cartridge lid 140 to stationary cartridge 70.

For purposes of this application, in the exemplary embodiment, stationary cartridge 70, upper lip seal spacer 120, lower lip seal spacer 110, upper lip seal 126, middle lip seal 128, and lower lip seal 130 shall be collectively referred to herein as lower seal assembly 150 (FIGS. 2 and 3).

Snap ring 152 is received within a groove formed on an inside surface of second section 46 of seal housing 40. Snap ring 152 is provided for securing lower seal assembly 150 within seal housing 40.

Wear sleeve 160 (FIGS. 2-5) is located inside of lower seal assembly 150. Wear sleeve 160 has an outside surface in sealing communication with an inside surface of upper lip seal 126, middle lip seal 128, and lower lip seal 130. Wear sleeve 160 additionally defines a drive screw orifice 162 (FIG. 3).

Referring now primarily to FIG. 2, a rotary mandrel 170 has an outer surface that defines cap screw threads 172 on an upper end thereof. Outer surface of rotary mandrel 170 additionally defines a first diameter 174 and minor flange 176 that defines a shoulder, a second diameter 178 that defines threads 180 (FIGS. 2 and 3) on a lower portion thereof, and a third diameter 182 (FIG. 3) for mating against an inside surface of wear sleeve 160. Rotary mandrel 170 additionally defines radial drive screw orifice 184 (FIG. 3) and a lower end of rotary mandrel 170 at third diameter 182. Rotary mandrel 170 has an interior surface defining a tapered upper chamber 186 and a longitudinal interior space 188. O-rings are located between the inside surface of wear sleeve 160 and an outer surface of rotary mandrel 170 at third diameter 182.

As shown is FIG. 3, lock nut 200 is threadably connected to rotary mandrel 170 via threads 180. Lock washer 202 is in communication with an upper surface of lock nut 200.

Referring back to FIG. 2, lower tapered roller bearing 210 is located between an inside surface of bearing housing 14 and outer surface of rotary mandrel 170 at second diameter 178 of rotary mandrel 170. Lower tapered roller bearing 210 communicates with lock nut 200 and lower shoulder 22 on inside surface 16 of bearing housing 14.

Upper tapered roller bearing 220 is located between the inside surface of bearing housing 14 and outer surface or rotary mandrel 170 at second diameter 178 of rotary mandrel 170. Upper tapered roller bearing 220 communicates with upper shoulder 20 on inside surface 16 of bearing housing 14. Grease seal 222 is located between upper diameter 24 of bearing housing 14 and minor flange 176 of rotary mandrel 170.

Lock out plate 230 has an inside diameter that surrounds first diameter 174 of rotary mandrel 170. Lock out plate 230 preferably defines a plurality of bolt receiving holes 232 therein. A plurality of cap screws 234 are received within bolt receiving holes 232 of lock out plate 230 and within bolt receiving holes 32 of bearing housing 14. Cap screws 234 are provided for securing lock out plate 230 to bearing housing 14.

A seal, such as polypak seal 240, is received within tapered upper chamber 186 of rotary mandrel 170. Polypak seal 240 has an inside diameter and an outside diameter. Polypak seal washer 242 is in communication with an upper surface of polypak seal 240 with an upper tapered chamber 186 of rotary mandrel 170. For purposes of this application, polypak seal 240 and polypak seal washer 242 shall be referred to as upper seal assembly 250.

Mandrel drive cap 260 has an inside surface defining threads that are threadably received on cap screw threads 172 on the upper portion of rotary mandrel 170. The inside surface of mandrel drive cap 260 additionally defines an inwardly protruding ring 262 and an upper inside surface 264. Inwardly protruding ring 262 communicates with an upper surface of rotary mandrel 170.

Mandrel compression drive 270 has an upper section in communication with upper inside surface 264 of mandrel drive cap 260. Mandrel compression drive 270 further defines a tapered lower section for communicating with tapered upper chamber 186 of rotary mandrel 170. A transition between an upper section of mandrel compression drive and the tapered lower section of the mandrel compression defines a lip 272 that communicates with inwardly protruding ring 262 of mandrel drive cap 260. Lock ring 274 is received within an annular groove defined by upper inside surface 264 of mandrel drive cap 260 for securing mandrel compression drive 270 partially within mandrel drive cap 260.

Polished rod 280 is received within rotary mandrel 170. Polished rod 280 communicates with mandrel compression drive 270 and the upper seal assembly 250. Polished rod 280 additionally passes through the longitudinal interior space 188 of rotary mandrel 170.

As shown in FIG. 3, drive screw 290 is received within drive screw orifice 162 of wear sleeve 160 and within drive screw orifice 184 of rotary mandrel 170 for selective engagement with polished rod 280.

In practice, rotary seal unit 10 of the invention utilizes rotating mandrel 170 to isolate polish rod 280 from running elements, such as upper lip seal 126, middle lip seal 128, and lower lip seal 130. By isolating polish rod 280 from lip seals 126, 128 and 130, wear of polish rod 280 is eliminated. Tapered upper chamber 186 of mandrel 170 contains upper seal assembly 250 that seals and grips polish rod 280 so that polish rod 280 drives mandrel 170. Multiple lip seals 126, 128, and 130 form a seal therebetween. Space between multiple lip seals 126, 128 and 130 communicates with exterior orifice 60 through orifice 88 in stationary cartridge 70 and spacer orifice 124 in upper lip seal spacer 120. An operator may open lower breather petcock 62 in orifice 60 to check for the presence of fluid. Fluid proximate exterior orifice 60 indicates a failure of one or more of lip seals 128 and 130. Thus, sealing failure of RSU 10 may be detected prior to external leakage of well fluid.

Replacement of a rotary seal unit 10 requires removal of the drivehead, which is a time consuming procedure. Further, an unexpected failure of a rotary seal unit 10 may necessitate untimely and costly downtime for the well. RSU 10 of the invention allows for the drivehead to be shut down and for mandrel 280 to be locked to the body or housing 12 of RSU 10. Once the drivehead is shut down, the upper seal assembly 250, e.g., the poly seal may be replaced by packing such as a Teflon and graphite packing. Once the packing is installed, the upper seal assembly 250 becomes static and seals against the rotating polish rod 280. Once the packing is installed in the upper seal assembly 250, RSU 10 may be operated as a conventional stuffing box until replacement of the RSU is convenient to field operations.

Advantages of the RSU of the invention include utilizing a primary seal and a secondary static seal for increased reliability. An accessible external port provides an early warning in advance of a primary seal failure. In the event of a primary seal failure, a secondary seal can be converted to avoid an unscheduled shutdown of the pumping system. The secondary sealing system operates as a conventional stuffing box using Teflon and graphite packing that can continue to be utilized until a maintenance event can be scheduled, thus avoiding a costly addition shut-down.

An added benefit of the RSU of the invention is reduced polished rod wear. The primary seals are designed so that while in operation the wear to the polished rod is reduced or eliminated.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A seal for a progressing cavity pump drivehead comprising:

a seal housing for receiving a polish rod;

a mandrel at least partially located in said seal housing, said mandrel adapted for selective rotation with respect to said polish rod;

a primary seal surrounding said mandrel;

a secondary seal for sealing engagement with said polish rod;

a locking mechanism for selectively securing said mandrel in a stationary orientation with respect to said seal housing.

2. The seal according to claim 1 further comprising:

a wear sleeve surrounding said mandrel; and wherein said primary seal sealingly engages said wear sleeve.

3. The seal according to claim 1 further comprising:

an external orifice in communication with an area proximate said primary seal, said external orifice for providing access for an operator to check for fluids leaking past said primary seal.

4. The seal according to claim 1 wherein:

said secondary seal rotates with said polish rod in a first configuration and said secondary seal is adaptable for use as a static seal in a second configuration.

5. The seal according to claim 1 wherein:

said secondary seal comprises poly style packing.

6. The seal according to claim 1 wherein:

said mandrel is comprised of a single piece.

7. The seal according to claim 1 wherein:

said primary seal is comprised of a plurality of lip seals.

8. The seal according to claim 7 wherein:

an external orifice communicates with an area proximate said plurality of lip seals, said external orifice for providing access for an operator to check for fluids leaking past said plurality of lip seals.

9. The seal according to claim 7 further comprising:

a lip seal spacer for mounting one of said plurality of lip seals thereon;

said lip seal spacer defining a spacer orifice in fluid communication with an external orifice, said external orifice for providing access for an operator to check for fluids leaking past said plurality of lip seals.

10. A method of operating a rotary seal comprising the steps of:

surrounding a polish rod with a mandrel;

surrounding said mandrel with a primary seal;

rotating a secondary seal with said polish rod for sealing engagement with said polish rod;

checking for leakage of said primary seal through an exterior port;

securing said mandrel in a stationary orientation with respect to a seal housing; and rotating said polish rod within said secured mandrel.

11. The method according to claim 10 further comprising the step of:

after said step of securing said mandrel, operating said secondary seal as a stationary seal.

12. A method of operating a rotary seal comprising the steps of:

surrounding a polish rod with a mandrel;

surrounding said mandrel with a primary seal;

rotating a secondary seal with said polish rod for sealing engagement with said polish rod;

checking for leakage of said primary seal through an exterior port;

surrounding said mandrel with a wear sleeve; and sealingly engaging said wear sleeve with said primary seal.

13. A well having a progressive cavity pump deployed therein, said well comprising:

a wellhead;

a seal housing affixed to said wellhead, said seal housing for receiving a polish rod;

a mandrel at least partially located in said seal housing, said mandrel adapted for selective rotation with respect to said polish rod;

a primary seal for surrounding said mandrel;

a secondary seal for sealing engagement with said polish rod;

a locking mechanism for selectively securing said mandrel in a stationary orientation with respect to said seal housing.

14. The well according to claim 13 further comprising:

a wear sleeve surrounding said mandrel; and wherein said primary seal sealingly engages said wear sleeve.

15. The well according to claim 13 wherein:

an external orifice communicates with an area proximate said primary seal, said external orifice for providing access for an operator to check for fluids that have leaked past said primary seal.

16. The well according to claim 13 wherein:

said secondary seal rotates with said polish rod in a first configuration and said secondary seal is adaptable for use as a static seal in a second configuration.

17. The well according to claim 13 wherein:

said secondary seal comprises poly style packing.

18. The well according to claim 13 wherein:

said mandrel is comprised of a single piece.

19. The well according to claim 13 wherein:

said primary seal is comprised of a plurality of lip seals.

20. The well according to claim 19 wherein:

an external orifice communicates with an area proximate said plurality of lip seals, said external orifice for providing access for an operator to check for fluids that have leaked past said plurality of lip seals.

21. The well according to claim 19 further comprising:

a lip seal spacer for mounting one of said plurality of lip seals thereon;

said lip seal spacer defining a spacer orifice in fluid communication with an external orifice, said external orifice for providing access for an operator to check for fluids that have leaked past said plurality of lip seals.

22. A seal for a progressing cavity pump drivehead comprising:

a seal housing for receiving a polish rod;

a mandrel at least partially located in said seal housing, said mandrel adapted for selective rotation with said polish rod;

a primary seal surrounding said mandrel;

a wear sleeve surrounding said mandrel wherein said primary seal sealingly engages said wear sleeve;

a secondary seal for sealing engagement with said polish rod; and a locking mechanism for selectively securing said mandrel in a stationary orientation with respect to said seal housing.

23. A well having a progressive cavity pump deployed therein, said well comprising:

a wellhead;

a seal housing affixed to said wellhead, said seal housing for receiving a polish rod;

a mandrel at least partially located in said seal housing, said mandrel adapted for selective rotation with said polish rod;

a primary seal for surrounding said mandrel;

a wear sleeve surrounding said mandrel wherein said primary seal sealingly engages said wear sleeve;

a secondary seal for sealing engagement with said polish rod;

a locking mechanism for selectively securing said mandrel in a stationary orientation with respect to said seal housing.

* * * * *